US009303405B2

(12) United States Patent
Nelson et al.

(10) Patent No.: US 9,303,405 B2
(45) Date of Patent: Apr. 5, 2016

(54) MODULAR TRUSS SYSTEM

(71) Applicants: Chris A. Nelson, Harrisburg, SD (US); Lucas L. Lorenzen, Sioux Falls, SD (US)

(72) Inventors: Chris A. Nelson, Harrisburg, SD (US); Lucas L. Lorenzen, Sioux Falls, SD (US)

( * ) Notice: Subject to any disclaimer, the term of this patent is extended or adjusted under 35 U.S.C. 154(b) by 0 days.

(21) Appl. No.: 14/456,447

(22) Filed: Aug. 11, 2014

(65) Prior Publication Data

US 2015/0047287 A1 Feb. 19, 2015

Related U.S. Application Data

(60) Provisional application No. 61/865,364, filed on Aug. 13, 2013.

(51) Int. Cl.

| | |
|---|---|
| ***E04C 3/38*** | (2006.01) |
| ***E04C 3/40*** | (2006.01) |
| ***E04B 1/00*** | (2006.01) |
| ***E04C 3/09*** | (2006.01) |
| *E04B 1/32* | (2006.01) |
| *E04C 3/04* | (2006.01) |

(52) U.S. Cl.

CPC ... *E04C 3/40* (2013.01); *E04B 1/00* (2013.01); *E04C 3/09* (2013.01); *E04B 1/32* (2013.01); *E04B 2001/3235* (2013.01); *E04C 2003/0491* (2013.01)

(58) Field of Classification Search

CPC ..... E04B 1/32; E04B 1/03; E04B 7/022; E04B 7/026; E04B 7/028; E01D 4/00; E01D 6/00; E04C 3/40; E04C 3/38

USPC ..... 52/633, 639, 643, 644, 647, 653.1, 52/655.1, 241, 243

See application file for complete search history.

(56) References Cited

U.S. PATENT DOCUMENTS

| | | | | | |
|---|---|---|---|---|---|
| 2,058,386 | A | * | 10/1936 | Parsons | 52/290 |
| 2,138,291 | A | * | 11/1938 | Callaghan | 52/290 |
| 2,860,743 | A | * | 11/1958 | Cliff | 52/692 |
| 2,864,471 | A | * | 12/1958 | Williams | 52/692 |
| 3,019,491 | A | * | 2/1962 | Troutner | 52/474 |
| 3,680,271 | A | * | 8/1972 | Satchell | 52/656.1 |
| 3,733,755 | A | * | 5/1973 | Butler | 52/36.6 |
| 3,845,601 | A | * | 11/1974 | Kostecky | 52/290 |
| 3,849,961 | A | * | 11/1974 | Gwynne | 52/639 |
| 3,920,344 | A | | 11/1975 | Anderson | |
| 3,999,336 | A | | 12/1976 | Bance | |
| 4,122,647 | A | * | 10/1978 | Kovar | 52/695 |
| 4,170,852 | A | | 10/1979 | Danis, Jr. | |
| 4,222,211 | A | * | 9/1980 | Pearson | 52/745.12 |
| 4,435,940 | A | * | 3/1984 | Davenport et al. | 52/641 |
| 4,509,291 | A | * | 4/1985 | Geisthardt | 49/409 |
| 4,569,501 | A | * | 2/1986 | McCracken | 249/209 |
| 4,887,406 | A | * | 12/1989 | Saia | 52/694 |
| 4,961,297 | A | * | 10/1990 | Bernard | 52/93.1 |
| 4,991,368 | A | * | 2/1991 | Amstutz | 52/241 |
| 5,325,651 | A | * | 7/1994 | Meyer et al. | 52/715 |

(Continued)

*Primary Examiner* — Phi A

(57) ABSTRACT

A modular truss system includes an upper chord and a lower chord. Each of the upper and lower chords has a pair of terminal ends and each of the upper and lower chords is arcuate between associated ones of the pair of terminal ends. A plurality of branches is removably attached to and extends between the upper and lower chords. Each of the branches has a first end and a second end comprising a saddle that receives one of the upper or lower chords at a fixed angle with respect to the upper and lower chords. The saddles ensure the branches are properly placed on the upper and lower chords.

7 Claims, 8 Drawing Sheets

(56) References Cited

U.S. PATENT DOCUMENTS

| | | | | |
|---|---|---|---|---|
| 5,433,055 | A | 7/1995 | Schliep | |
| 5,596,859 | A * | 1/1997 | Horton et al. | 52/481.1 |
| 5,606,840 | A * | 3/1997 | Hase | 52/780 |
| 5,692,353 | A * | 12/1997 | Bass et al. | 52/653.1 |
| 5,797,233 | A * | 8/1998 | Hascall | 52/481.1 |
| 5,842,318 | A * | 12/1998 | Bass et al. | 52/653.1 |
| 6,026,613 | A * | 2/2000 | Quiring et al. | 52/63 |
| 6,189,930 | B1 * | 2/2001 | Kalazny | 280/781 |
| 6,557,254 | B1 * | 5/2003 | Johnson | 29/897.312 |
| 6,647,691 | B2 * | 11/2003 | Becker et al. | 52/656.1 |
| 6,842,981 | B2 | 1/2005 | Kennelly et al. | |
| 6,971,210 | B2 | 12/2005 | Kliegle et al. | |
| 7,409,804 | B2 * | 8/2008 | Moody et al. | 52/639 |
| 7,546,714 | B2 | 6/2009 | Masterson et al. | |
| 7,669,372 | B2 | 3/2010 | Schaffer | |
| 7,748,546 | B2 | 7/2010 | Konstant | |
| 7,765,771 | B2 * | 8/2010 | Serpico et al. | 52/846 |
| 7,850,390 | B2 * | 12/2010 | Lisbona | 403/382 |
| 8,079,192 | B2 | 12/2011 | Gerkes et al. | |
| 8,397,462 | B2 * | 3/2013 | Gulbrandsen et al. | 52/636 |
| 8,615,959 | B2 * | 12/2013 | Ferguson et al. | 52/653.1 |
| 2010/0275548 | A1 * | 11/2010 | Wright | 52/653.1 |

* cited by examiner

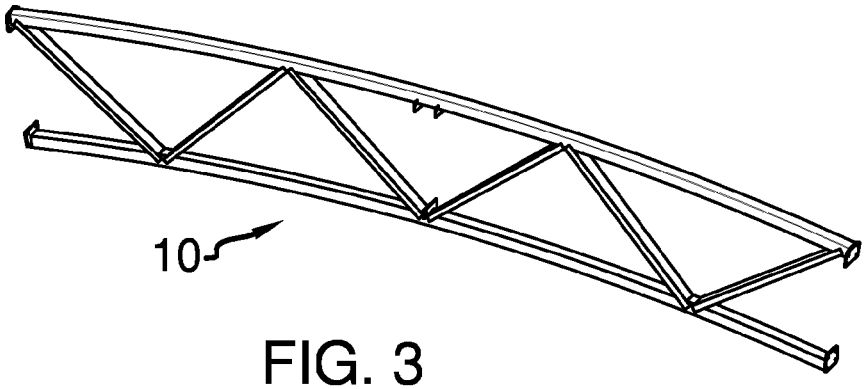
FIG. 3
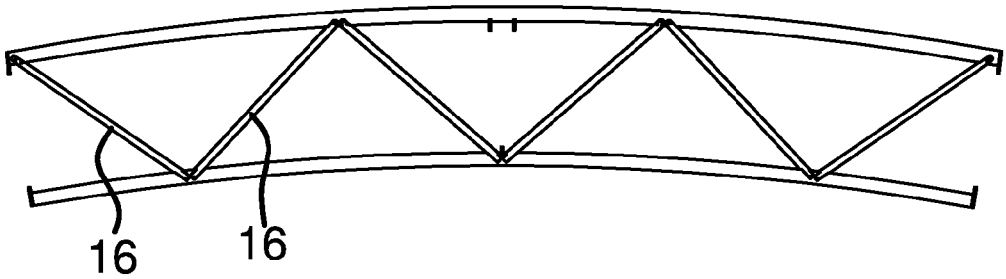
FIG. 4
FIG. 5
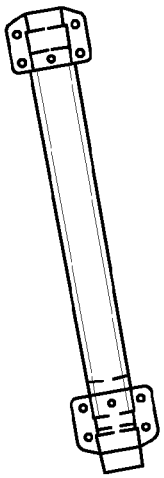

MODULAR TRUSS SYSTEM

This application claims the benefit of U.S. Provisional Application 61/865,364 filed on Aug. 13, 2013 under United States Code, Section 119(e).

BACKGROUND OF THE DISCLOSURE

Field of the Disclosure

The disclosure relates to truss devices and more particularly pertains to a new truss device for ensuring that the truss is properly assembled after being shipped in a modular, unassembled condition.

SUMMARY OF THE DISCLOSURE

An embodiment of the disclosure meets the needs presented above by generally comprising an upper chord and a lower chord. Each of the upper and lower chords has a pair of terminal ends and each of the upper and lower chords may be arcuate between associated ones of the pair of terminal ends. A plurality of branches is removably attached to and extends between the upper and lower chords. Each of the branches has a first end and a second end comprising a saddle that receives one of the upper or lower chords at a fixed angle with respect to the upper and lower chords. The saddles ensure the branches are properly placed on the upper and lower chords.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 3 is a perspective view of an embodiment of the disclosure.

FIG. 4 is a front view of an embodiment of the disclosure.

FIG. 5 is a side view of an embodiment of the disclosure.

DESCRIPTION OF THE PREFERRED EMBODIMENT

Figure 1A:
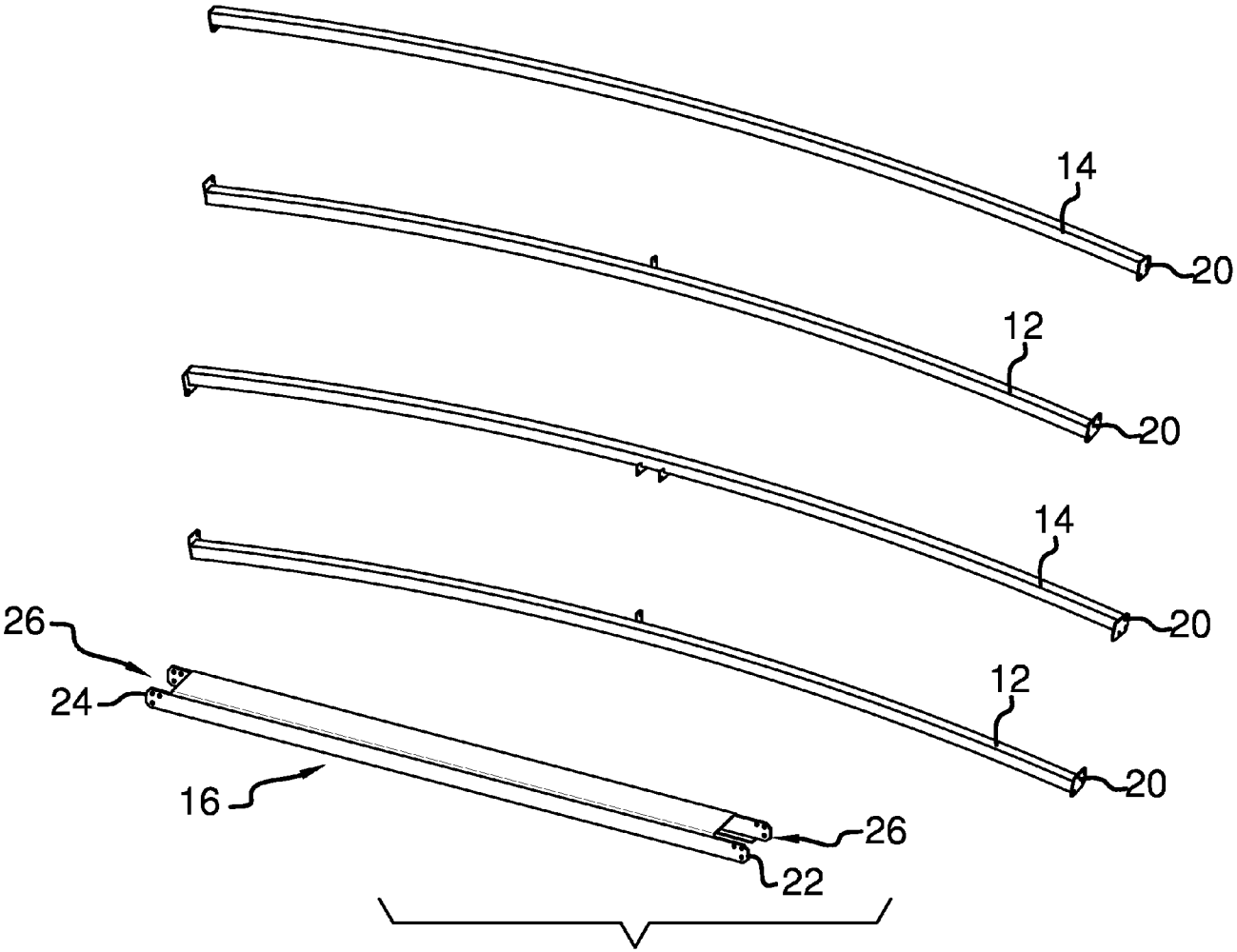
FIG. 1A is a plurality of perspective views of chords and branches of a modular truss system according to an embodiment of the disclosure.
Figure 1B:
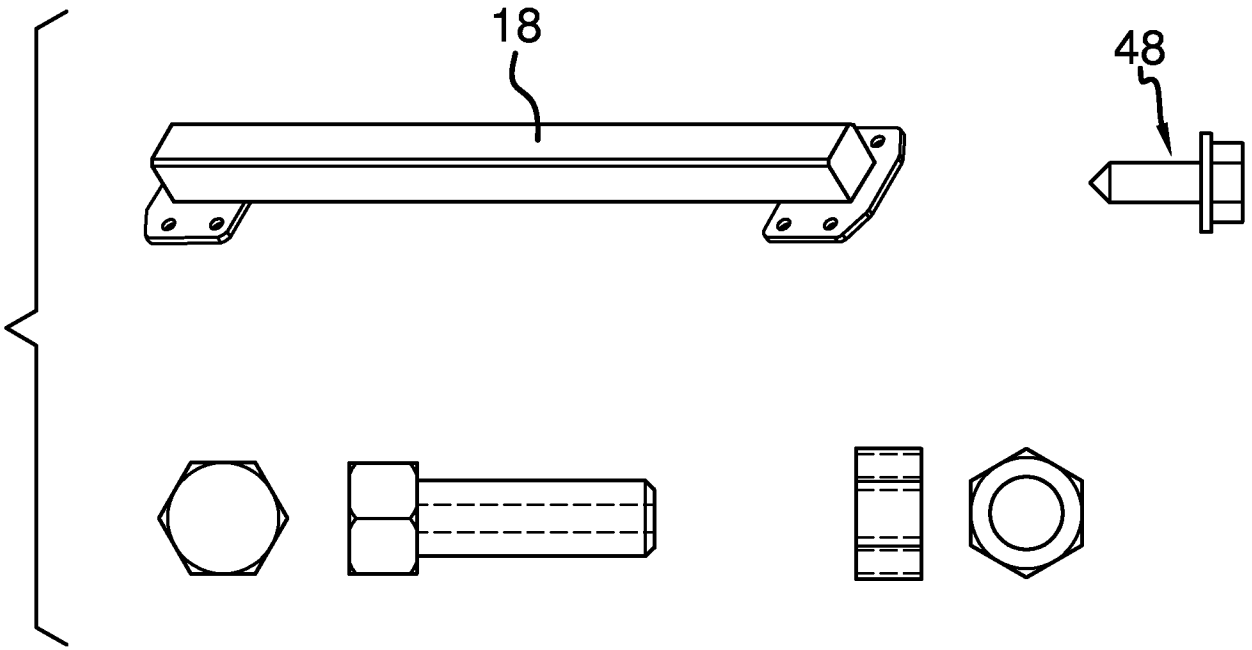
FIG. 1B is a perspective view of a bracket and side and front views of a fasteners of an embodiment of the disclosure.

With reference now to the drawings, and in particular to FIGS. 1 through 9 thereof, a new truss device embodying the principles and concepts of an embodiment of the disclosure and generally designated by the reference numeral 10 will be described.

As best illustrated in FIGS. 1 through 9, the modular truss system 10 generally comprises an upper chord 14, a lower chord 12 and a plurality of branches 16 extending between the upper 14 and lower 12 chords to define a truss. The truss (also overall considered the truss system 10), once assembled, is conventionally used to span an area between a pair of walls and forms the primary framework for the roofing of a storage structure. The upper 14 and lower 12 chords are arcuate between their terminal ends 20. Terminal brackets 18 may be attached to and extended between the terminal ends 20 of the upper 14 and lower 12 chords. The terminal brackets 18 may be attached to the upper 14 and lower 12 chords before the branches 16 to correctly position the upper 14 and lower 12 chords at a correct distance from each other. These terminal brackets 18 will typically be removed before installation and used for assembling other trusses 10. Mounts, not shown, may be attached to the truss 10, which extend between the truss 10 and walls of the storage structure.

The branches 16 each have an upper end 22 and a lower end 24 each comprising a saddle 26 for receiving one of the upper 14 and lower 12 chords, wherein the upper ends 22 engage the upper chord 14 and the lower ends 24 engage the lower chord 12. The saddles 26 are formed in the upper 22 and lower 24 ends. More particularly, the branches 16 each include an upper wall 28, a lower wall 30, a first lateral wall 32 and a second lateral wall 34. The upper walls 28 generally face the upper chord 14 while the lower walls 30 generally face the lower chord 12. As can be seen in the Figures, and in particular FIG. 8, the lower walls 30 may only be partially formed and may not span completely the distance between the first 32 and second 34 lateral walls. This shape is advantageous as it allows the branches 16 to be formed out of a single, flat plate 36 having series of bends therein, and further the lower wall 30 being open will further ensure proper installation as a visual indicator with regards to which side should be facing up or down. The upper 28 and lower 30 walls each have notches therein so that the first 32 and second 34 lateral walls form flanges 38 extending away from the upper 28 and lower walls 30. Also, shoulders are formed in the upper 28 and lower 30 by the notches and are bounded by the flanges 38. The shoulders may be defined as a first shoulder 41 positioned in the upper wall 28 and adjacent to the upper end 22, a second shoulder 42 positioned in the lower wall 30 and adjacent to the upper end 22, a third shoulder 43 positioned in the upper wall 28 and adjacent to the lower end 24 and a fourth shoulder 44 positioned in the lower wall 30 and adjacent to the lower end 24.

The flanges 38 each have a free end. A distance between the first shoulder 41 and the adjacent free ends is greater than a distance between the second shoulder 42 the adjacent free ends. A distance between the third shoulder 43 and the adjacent free ends is less than a distance between the fourth shoulder 44 and the adjacent free end. When the branches 16 are positioned on the upper 14 and lower 12 chords, the first 41 and second 42 shoulders each abut the upper chord 14 while the third 43 and fourth 44 shoulders each abut the lower chords 12. The first 32 and second 34 lateral walls have a same length with respect to each other such that the free ends of the flanges 38, or first 32 and second 34 lateral walls, are aligned with each other. Because the first 41 and second 42 shoulders are effectively staggered with respect to each other, the branch 16 will not be perpendicular to the upper chord 14 when the upper end 22 receives the upper chord 14 and the first 41 and second 42 shoulders each abut the upper chord 14. The same will be true when each of the third 43 and fourth 44 shoulders abut the lower chord 12. The effect of this structure is that a person assembling the truss system 10 will only be able to place the branches 16 in one direction such that the first 41 through fourth 44 shoulders all abut the upper 14 or lower 12 chord while retaining the upper 14 and lower 12 chords in a correct spatial orientation with respect to each other. That is, the upper 14 and lower 12 chords may only be retained at a correct distance with respect to each other if the branch 16 is properly positioned on the upper 14 and lower 12 chords.

Figure 9:
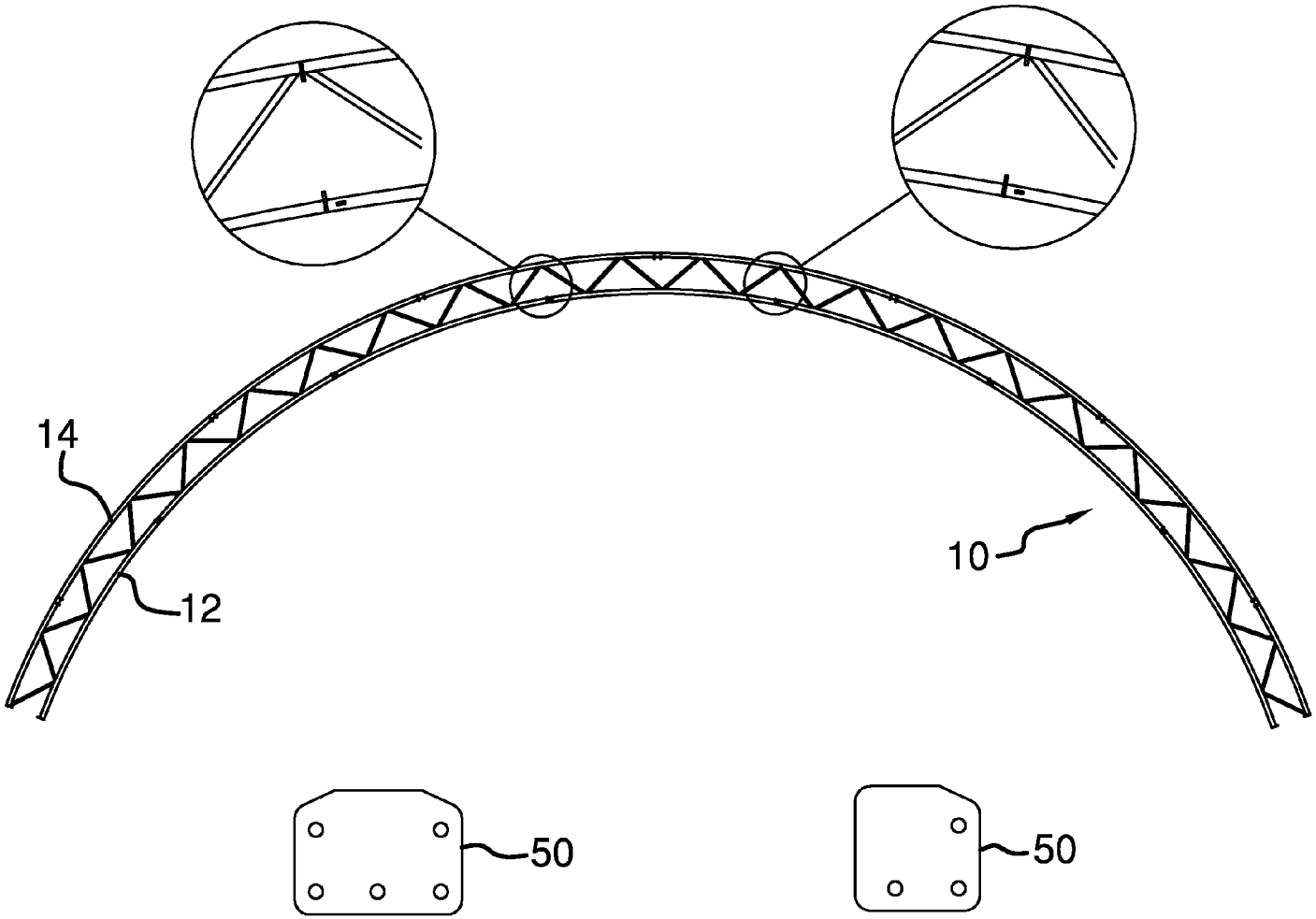
FIG. 9 is a front view of an embodiment of the disclosure.

The flanges 38 may include apertures 46 for receiving fasteners 48 that are extendable through the flanges 38 and into either the upper chord 14 or the lower chord 12. The fasteners 48 retain the branches 16 in a static position relative to the upper 14 and lower 12 chords and other ones of the branches 16. As can be seen in the Figures, the branches 16 will be alternated such that moving from one end of the truss system 10 to the other end of the truss system 10 the upper end 22 of one branch 16 will be adjacent to and may abut a next upper end 22 of another branch 16, and the lower end 24 of one branch 16 will be adjacent to and may abut a lower end 24 of another branch 16 to define alternating triangles formed of one of the upper or lower chords and two of the branches. More specifically, the lower walls 30 each form an acute angle with the lower chord 14 and the upper walls 28 each form an obtuse angle with the lower chord 14. Moreover, an angle formed between adjacent ones of said upper walls 28 is between 60° and 120°. As can be seen in FIG. 9, shims 50, though not required, may be added where needed to fill small spaces between adjacent ones of the branches 16.

Figure 2A:
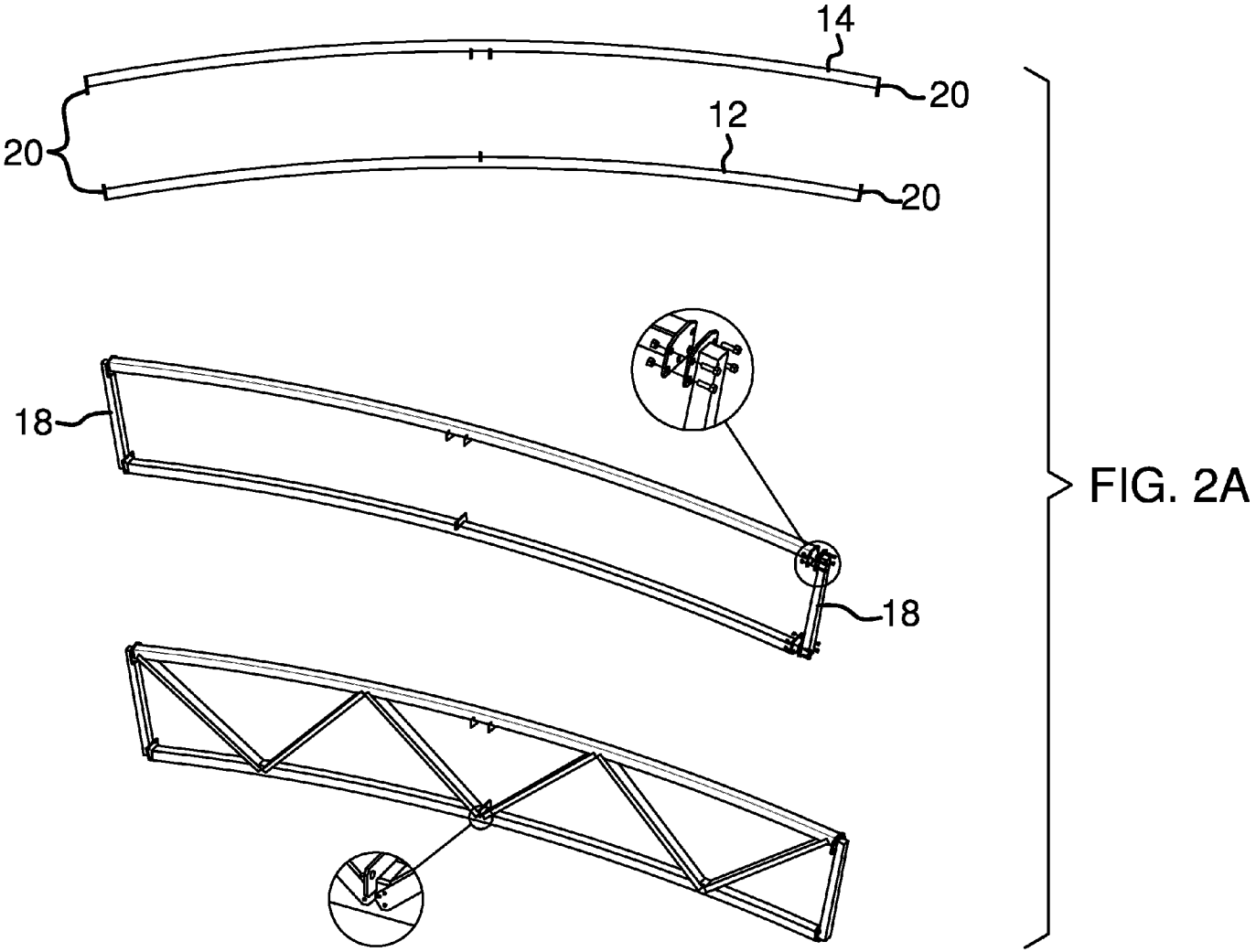
FIG. 2A is a schematic view of an embodiment of the disclosure.
Figure 2B:
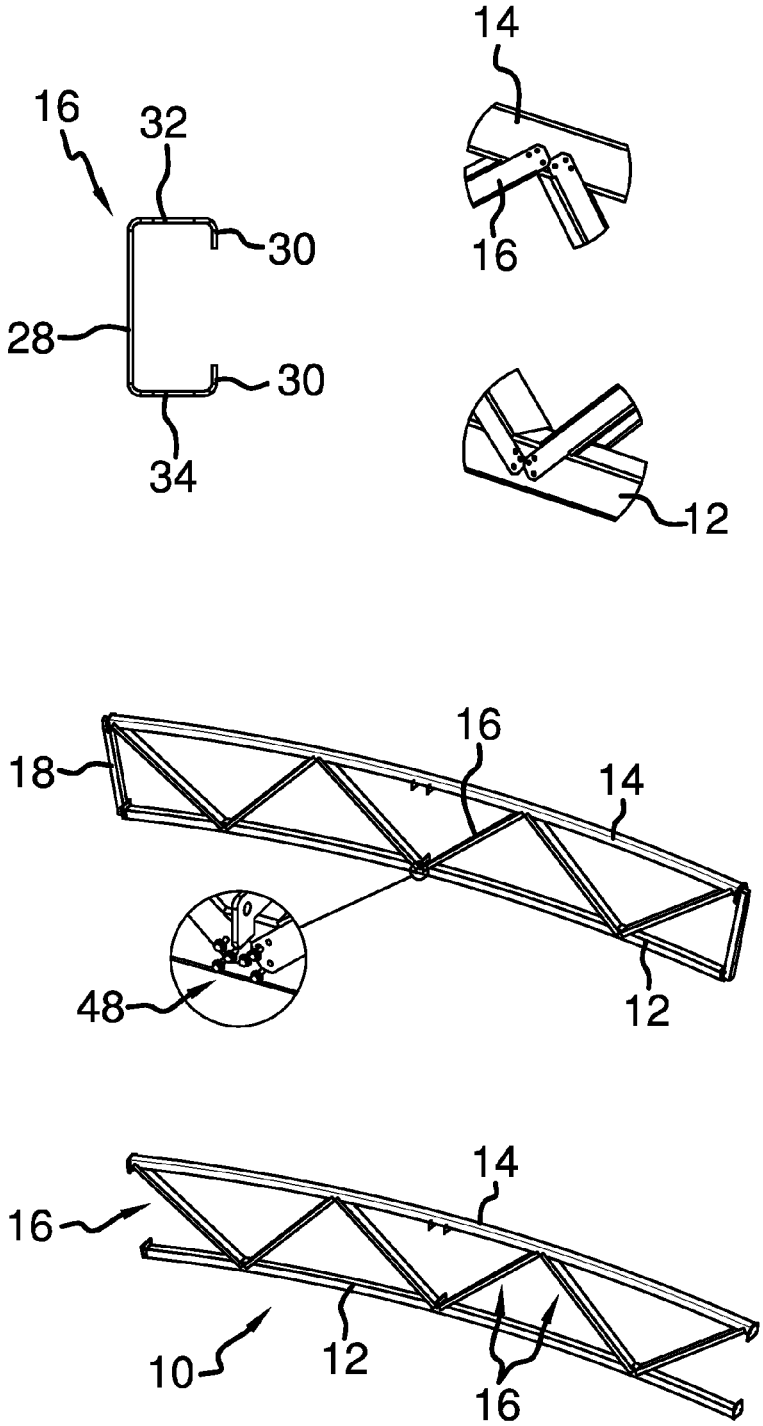
FIG. 2B is a schematic view of an embodiment of the disclosure.
Figure 6:
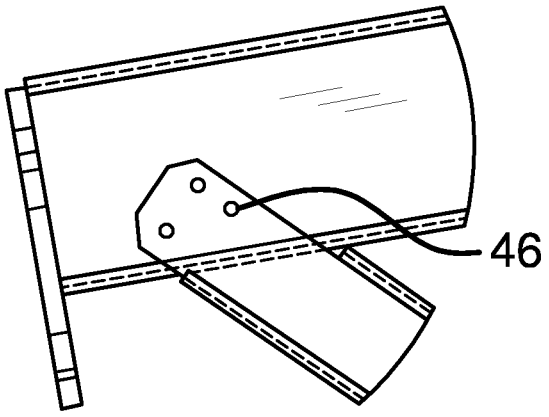
FIG. 6 is a broken side view of an embodiment of the disclosure.
Figure 7:
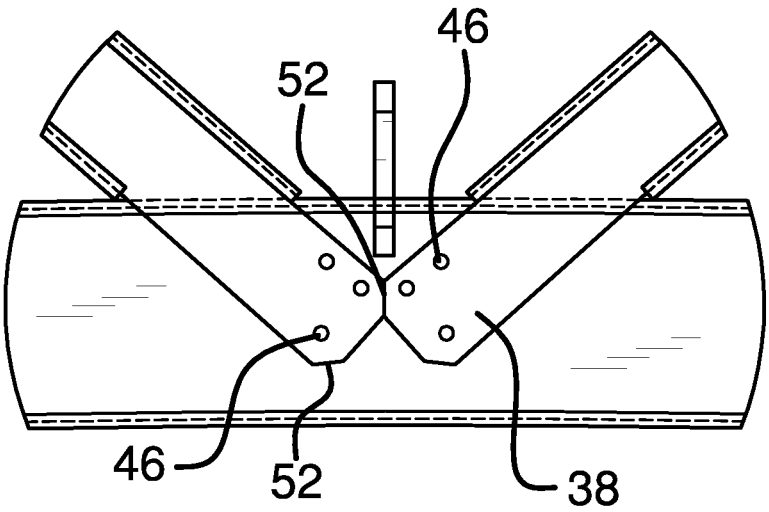
FIG. 7 is a broken side view of an embodiment of the disclosure.
Figure 8:
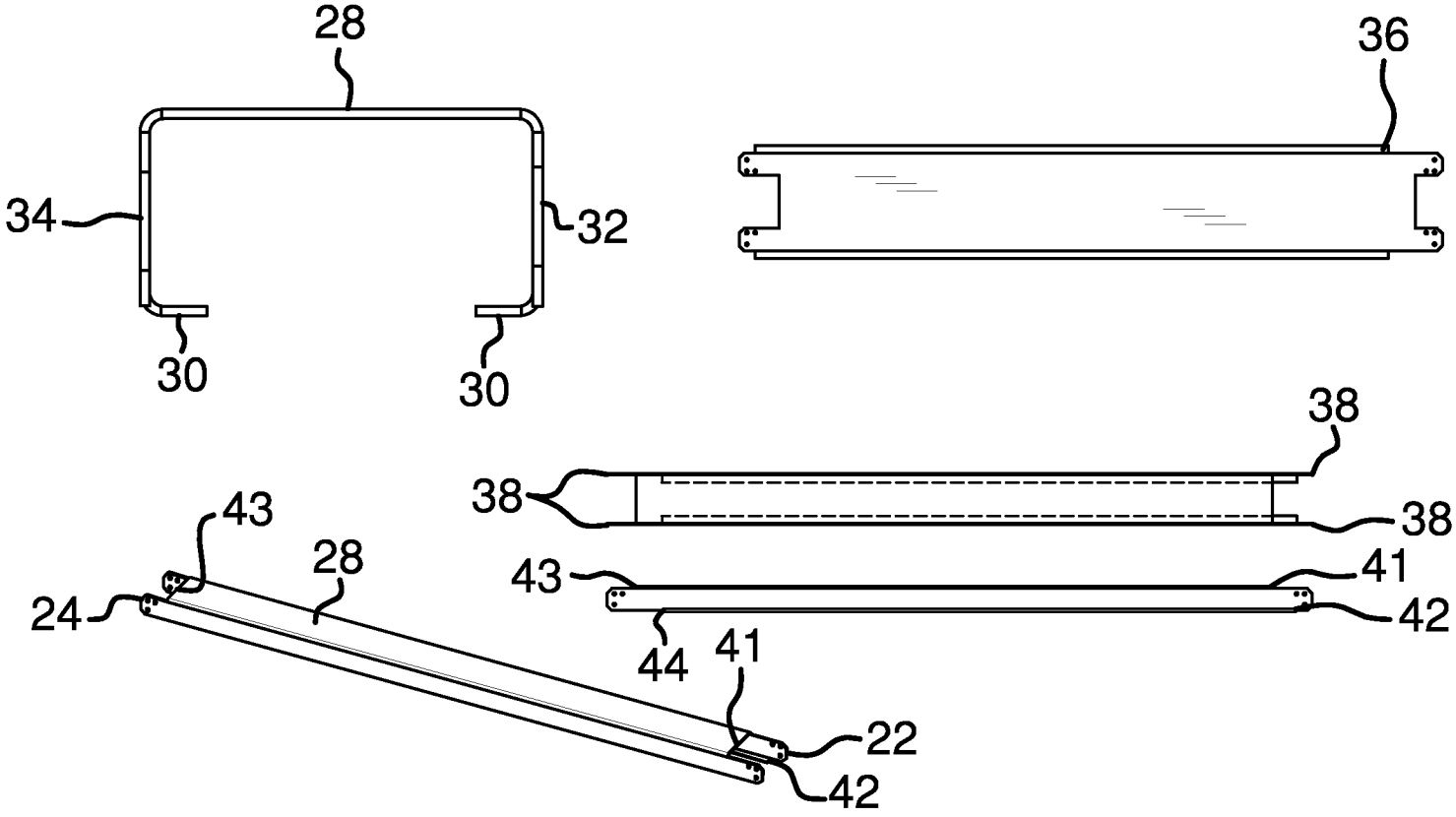
FIG. 8 is a plurality of views of a branch of an embodiment of the disclosure including a plate, a top view, a broken side view, a top perspective view and an end view.

In order to ensure the proper lateral placement of the branches 16 as one moves along the upper 14 and lower 12 chords from one end to the other, the flanges 38 of adjacent ones of the branches 16 may be abutted as shown in FIGS. 2B and 7. This will prevent the accidental placement of branches 16 too far from each other. The flanges 38 may have angled edges 52 extending away from the free ends. The angled edges 52 have an angle with respect to a top or bottom edge of the first 32 or second 34 lateral walls equal to 180° minus ½ of the angle formed by adjacent ones of the branches 16. The angled edges 52 of adjacent branches 16 may then be abutted against each other wherein a line formed by their joining bisects the angle of formed between adjacent branches 16. Alternatively, the free edges of the flanges 38 may be arcuate since the staggered shoulders 41-44 will already ensure the proper angle of branches 16 with respect to each other. The free edges of the flanges 38 will therefore have a pre-determined distance from the associated ones of the shoulders 41-44 and may be shaped along pre-determined arc.

In use, the truss system 10 will be used to form generally conventional trusses which will be used for forming a framework for a storage structure covering. For example, the trusses 10 may be covered with a fabric material such that a covering for grain storage is formed. The terminal brackets 18 may be attached to the upper 14 and lower 12 chords to correctly space them from each other and then the branches 16 are then added, one by one, along the span of the upper 14 and lower 12 chords. It should be understood that the terminal brackets 18 need not be added. The saddles 26 of each branch 16 include a pair of staggered shoulders 41/42 or 43/44 to ensure that the branches 16 are only mounted onto the upper 14 and lower 16 chords in one direction. Moreover, the flanges 38 may have a size and shape for abutment to each other to further provide assurances that the branches 16 are properly spaced with respect to each other. These features allow the truss system 10 to be shipped as a kit without concern that the resulting trusses 10 will be incorrectly assembled. This in turn will dramatically lower the shipping costs as a modular system will use far less container volume for shipping purposes than will pre-assembled trusses.

It should be understood that any measurements shown in the Figures are for example only as these measurements may be altered depending on the size and usage of the truss 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A modular truss system comprising:

an upper chord and a lower chord, each of said upper and lower chords having a pair of terminal ends, each of said upper and lower chords being arcuate between associated ones of said pair of terminal ends; and a plurality of branches being removably attached to and extending between said upper and lower chords, each of said branches having a first end and a second end comprising a saddle receiving one of said upper or lower chords at a fixed angle with respect to said upper and lower chords, wherein said saddles ensure said branches are properly placed on said upper and lower chords each of said branches including;

an upper wall;

a lower wall;

a first lateral wall;

a second lateral wall, said first and second lateral walls being attached to and extending between said lower and upper walls; and said upper and lower walls each having notches therein such that said first and second lateral walls form flanges extending away from said upper and lower walls, wherein shoulders are defined in said upper and lower walls by the notches, said shoulders being bounded by said flanges, said shoulders including a first shoulder positioned in said upper wall and adjacent to said upper end, a second shoulder positioned in said lower wall and adjacent to said upper end, a third shoulder positioned in said upper wall and adjacent to said lower end and a fourth shoulder positioned in said lower wall and adjacent to said lower end, said shoulders being abutted against an associated one of said upper and lower chords.

2. The modular truss system according to claim 1, further including a pair of terminal brackets, each of said terminal brackets extending between and being removably attached so said terminal ends of said upper and lower ends to facilitate proper spacing between said upper and lower chords.

3. The modular truss system according to claim 1, wherein said flanges each have a free end, a distance between said first shoulder and adjacent ones of said free ends being greater than a distance between said second shoulder and said adjacent ones of said free ends, a distance between said third shoulder and adjacent ones of said free ends is less than a distance between said fourth shoulder and said adjacent ones of said free ends, said first and second shoulders each abutting said upper chord while said third and fourth shoulders each abut said lower chord, said branches being non-perpendicular to said upper and lower chords.

4. The modular truss system according to claim 3, wherein;

said first and second lateral walls have a same length with respect to each other such that said free ends of said flanges are aligned with each other; and said flanges each having apertures extending therethrough and receiving fasteners extendable through said flanges and into said upper or lower chords.

5. The modular truss system according to claim 3, wherein;

said branches being alternated such that said upper end of each branch is positioned adjacent to an upper end of a next one of said branches and said lower end of each branch is positioned to a lower end of a next one of said branches; and said flanges having angled edges with respect to a top edge of associated first and second lateral edges to 180° minus one-half of an angle formed by adjacent ones of said branches to facilitate abutment of flanges of adjacently positioned branches.

6. The modular truss system according to claim 1, wherein;

said branches being alternated such that said upper end of each branch is positioned adjacent to an upper end of a next one of said branches and said lower end of each branch is positioned to a lower end of a next one of said branches; and said flanges having angled edges with respect to a top edge of associated first and second lateral edges to 180° minus one-half of an angle formed by adjacent ones of said branches to facilitate abutment of flanges of adjacently positioned branches.

7. A modular truss system comprising:

an upper chord and a lower chord, each of said upper and lower chords having a pair of terminal ends, each of said upper and lower chords being arcuate between associated ones of said terminals ends;

a plurality of branches being removably attached to said upper and lower chords, each of said branches having an upper end and a lower end, each of said upper and lower ends comprising a saddle for receiving one of said upper or lower chords, each of said upper ends engaging said upper chord and each of said lower ends engaging said lower chord;

each of said branches including;

an upper wall;

a lower wall;

a first lateral wall;

a second lateral wall, said first and second lateral walls being attached to and extending between said lower and upper walls;

said upper and lower walls each having notches therein such that said first and second lateral walls form flanges extending away from said upper and lower walls, wherein shoulders are defined in said upper and lower walls by the notches, said shoulders being bounded by said flanges, said shoulders including a first shoulder positioned in said upper wall and adjacent to said upper end, a second shoulder positioned in said lower wall and adjacent to said upper end, a third shoulder positioned in said upper wall and adjacent to said lower end and a fourth shoulder positioned in said lower wall and adjacent to said lower end;

said flanges each having a free end, a distance between said first shoulder and adjacent ones of said free ends being greater than a distance between said second shoulder and said adjacent ones of said free ends, a distance between said third shoulder and adjacent ones of said free ends is less than a distance between said fourth shoulder and said adjacent ones of said free ends, said first and second shoulders each abutting said upper chord while said third and fourth shoulders each abut said lower chord, said branches being non-perpendicular to said upper and lower chords;

said first and second lateral walls have a same length with respect to each other such that said free ends of said flanges are aligned with each other;

said flanges each having apertures extending therethrough and receiving fasteners extendable through said flanges and into said upper or lower chords;

said branches being alternated such that said upper end of each branch is positioned adjacent to an upper end of a next one of said branches and said lower end of each branch is positioned to a lower end of a next one of said branches;

said lower walls each forming an acute angle with said lower chord and said upper walls each forming an obtuse angle with said lower chord; and said flanges having angled edges with respect to a top edge of associated first and second lateral edges to 180° minus one-half of an angle formed by adjacent ones of said branches to facilitate abutment of flanges of adjacently positioned branches.

* * * * *